US009580849B2

(12) United States Patent
Sugawara et al.

(10) Patent No.: US 9,580,849 B2
(45) Date of Patent: Feb. 28, 2017

(54) OVERLOCK SEWING MACHINE

(71) Applicant: JUKI CORPORATION, Tokyo (JP)

(72) Inventors: Kunihiko Sugawara, Tokyo (JP); Daishi Kuramashi, Tokyo (JP); Nobuaki Kinoshita, Tokyo (JP); Kiyoshi Minami, Tokyo (JP); Kazuhiro Mitani, Tokyo (JP)

(73) Assignee: JUKI CORPORATION, Tokyo (JP)

( * ) Notice: Subject to any disclaimer, the term of this patent is extended or adjusted under 35 U.S.C. 154(b) by 0 days.

(21) Appl. No.: 14/735,624

(22) Filed: Jun. 10, 2015

(65) Prior Publication Data

US 2015/0361606 A1 Dec. 17, 2015

(30) Foreign Application Priority Data

Jun. 11, 2014 (JP) ..... 2014-120098

(51) Int. Cl.
*D05B 37/06* (2006.01)
*D05B 73/12* (2006.01)
*D05B 1/12* (2006.01)

(52) U.S. Cl.
CPC ..... *D05B 37/063* (2013.01); *D05B 1/12* (2013.01); *D05B 37/06* (2013.01); *D05B 73/12* (2013.01)

(58) Field of Classification Search
CPC ..... D05B 37/04; D05B 37/06; D05B 37/063; D05B 37/066; D05B 73/12; D05B 1/12; D06H 7/16; B26D 3/10; B26F 1/382
See application file for complete search history.

(56) References Cited

U.S. PATENT DOCUMENTS 3,389,668 A * 6/1968 Marforio ..... D05B 37/04 112/125
4,384,540 A * 5/1983 Vollmar ..... D05B 37/06 112/122.1
5,052,317 A * 10/1991 Schips ..... D05B 37/06 112/129
5,289,789 A * 3/1994 Sakuma ..... D05B 37/063 112/122
6,101,960 A * 8/2000 Ebata ..... D05B 37/063 112/122
2005/0126459 A1 6/2005 Ebata et al.
2013/0333603 A1* 12/2013 Sugawara ..... D05B 37/06 112/128

FOREIGN PATENT DOCUMENTS

JP 4383842 B2 12/2009

* cited by examiner

*Primary Examiner* — Ismael Izaguirre
(74) *Attorney, Agent, or Firm* — Drinker Biddle & Reath LLP

(57) ABSTRACT

An overlock sewing machine includes a first switching part for switching an interlocked state where an upper knife drive part and an upper knife are interlocked and a released state where the upper knife drive part and the upper knife are not interlocked; a second switching part for switching the upper knife between a projection position and a retreat position; and an operation part for switching the first switching part and the second switching part between a first mode, a second mode, and a third mode.

5 Claims, 14 Drawing Sheets

OVERLOCK SEWING MACHINE

CROSS-REFERENCE TO RELATED APPLICATION

The present application claims the benefit of priority of Japanese Patent Applications No. 2014-120098, filed on Jun. 11, 2014, which is incorporated herein by reference.

TECHNICAL FIELD

The invention relates to an overlock sewing machine and, specifically, to an overlock sewing machine having an upper knife for cutting a cloth edge to be sewn.

BACKGROUND ART

For example, in an overlock sewing machine, while cutting a cloth edge using an upper knife moving vertically in interlocking with a sewing machine main shaft, the cloth edge is sewn.

And, there is known an overlock sewing machine which, when the upper knife is not used, releases its interlock with the sewing machine main shaft and stops it below a needle plate to set it into its retreat state where it is retreated from its cloth edge cutting position, thereby facilitating cloth handling on the needle plate (see, for example, Japanese Patent Publication No. 4383842).

Also, in another sewing machine 200 shown in FIG. 14, when an upper knife 201 is released from its interlock with a sewing machine main shaft, it stops at its projection position on a needle plate 202, thereby enabling the upper knife 201 to be used as a cloth guide.

In the sewing machine of JP Publication No. 4383842, when the upper knife is set in the retreated state, cloth handling on the needle plate is facilitated. However, for a user not familiar with a sewing machine, the freedom of use is too high, thereby raising a fear that the finished state can be unstable.

Also, in the sewing machine 200 of FIG. 14, since the upper knife 201 remains projected from above the needle plate 202, in a sewing operation not requiring a cloth guide, the upper knife 201 provides an obstacle.

SUMMARY OF THE INVENTION

Thus, the object of the invention is provide an overlock sewing machine which is easier to use by enabling an upper knife to be switched between the interlocked state, retreat state and guide state thereof and has any one of the following characteristics (1)~(6).

(1) An overlock sewing machine comprises: an upper knife movable between a retreat position below a needle plate and a projection position above the needle plate, and, when moving vertically from above the needle plate, capable of cutting a sewing object in cooperation with a lower knife; an upper knife drive part for vertically moving the upper knife; an interlock switching part configured to switch an interlocked state where the upper knife drive part and upper knife are interlocked with each other and a released state where the upper knife drive part and the upper knife are not interlocked each other; an upper knife position switching part configured to switch the upper knife between the projection position and retreat position; and, an operation part configured to drive the interlock switching part and upper knife position switching part to switch a first mode where the interlock switching part provides the interlocked state and the upper knife position switching part sets the upper knife at the projection position, a second mode where the interlock switching part provides the released state and the upper knife position switching part sets the upper knife at the projection position, and a third mode where the interlock switching part provides the released state and the upper knife position switching part sets the upper knife at the retreat position.

(2) An overlock sewing machine according to (1), wherein the arrangement position of the upper knife in the second mode is a guide position which exists within the projection position and is lower than the top dead center of the upper knife.

(3) An overlock sewing machine according to (2), wherein the operation part includes a rotatable shaft body and a cam portion rotatable with the shaft body and engageable with the upper knife position switching part to operate such part, and the upper knife position switching part includes a first restriction portion, due to the engagement of the cam portion, for restricting the upper knife in the second mode to the guide position, and a second restriction portion, due to engagement of the cam portion with a position different from the first restriction portion, for restricting the upper knife in the third mode to the retreat position.

(4) An overlock sewing machine according to any one of (1)~(3), wherein the upper knife position switching part, when the cam portion is not engaged with the upper knife position switching part, switches the upper knife to the projection position in the first mode.

(5) An overlock sewing machine according to any one of (1)~(4), further including a knife position adjusting mechanism for adjusting the horizontal-direction positions of the lower and upper knives.

In the overlock sewing machine of (1), by operating the operation part, the first mode (interlocked state), second mode (guide state) and third mode (retreat state) can be switched over to each other, the machine is easier to use.

According to the overlock sewing machine of (2), in the second mode, the upper knife is set at the guide position existing within the projection position and lower than the upper dead center of the upper knife, thereby facilitating use of it as a guide.

According to the overlock sewing machine of (3), since the upper knife position switching part includes the first and second restriction portions, simply by changing the engagement position of the cam portion with the upper knife position switching part, the upper knife can be set at positions proper for the second and third modes.

According to the overlock sewing machine of (4), simply by changing the cam portion into a position not engaged with the upper knife position switching part, the upper knife can be set at a position proper for the first mode.

According to the overlock sewing machine of (5), since the knife position adjusting mechanism can adjust the horizontal-direction positions of the lower and upper knives, when the upper knife is used as a guide, it can be set at the optimum position, thereby facilitating use of it.

DETAILED DESCRIPTION

Now, description is given below specifically of an embodiment of the invention with reference to the drawings.

Figure 1:
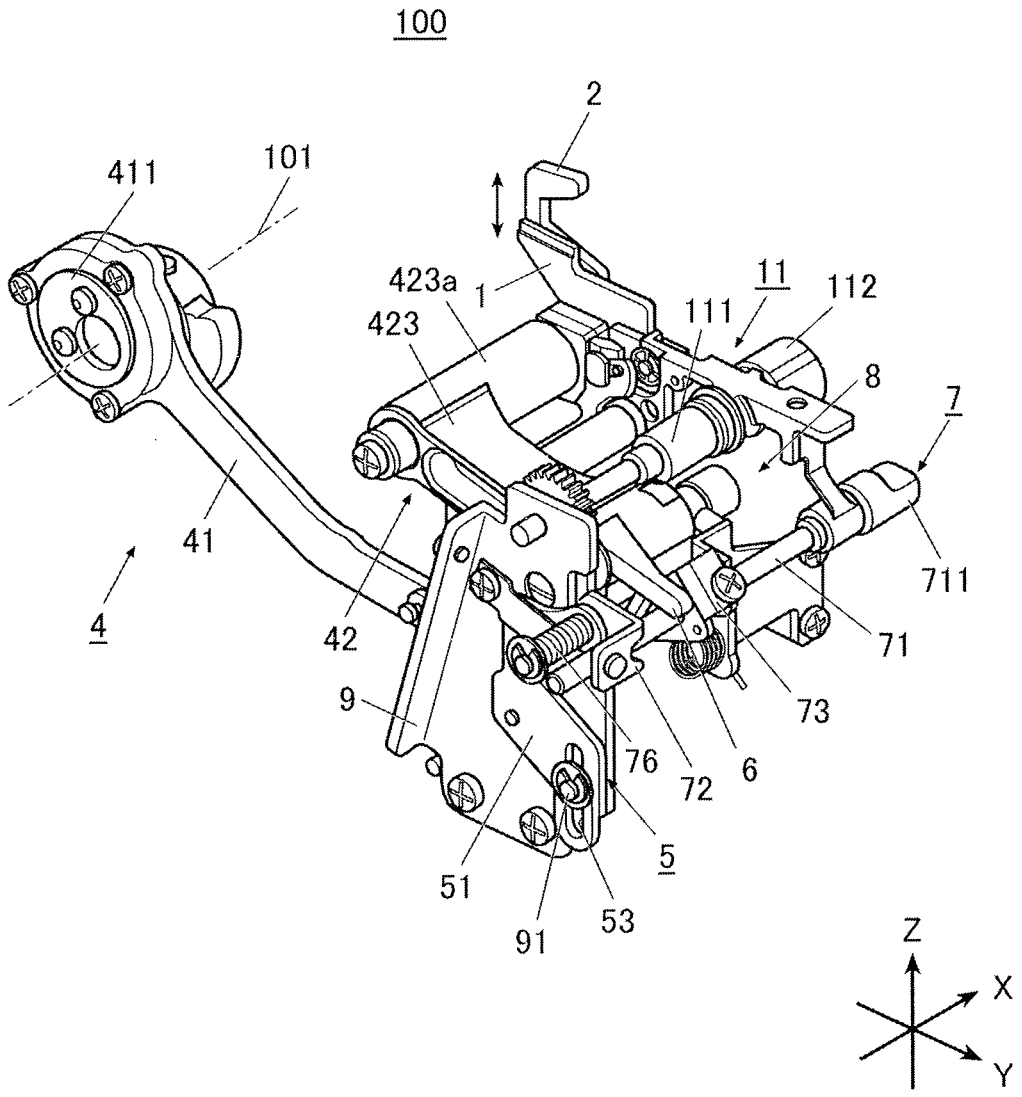
FIG. 1 is a perspective view showing the main portion structure of a sewing machine according to an embodiment of the invention.
Figure 2:
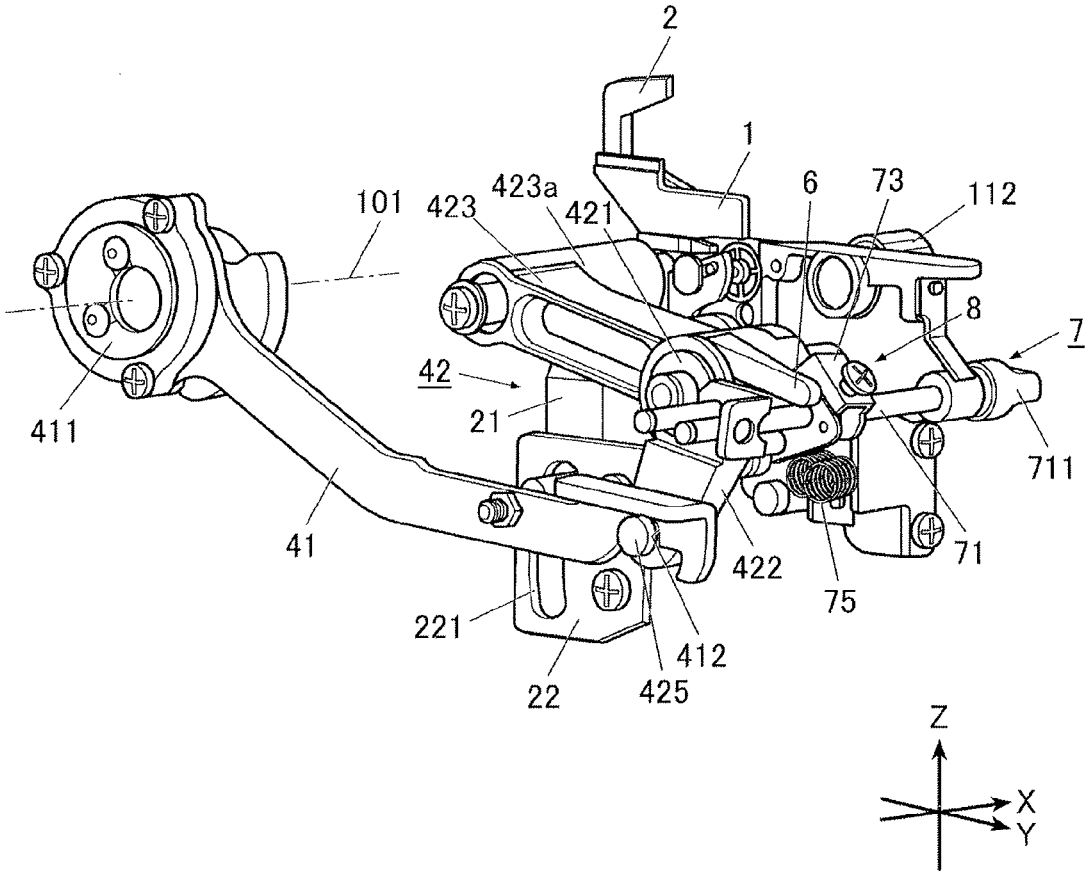
FIG. 2 is a perspective view showing the main portion structure of the embodiment.
Figure 3:
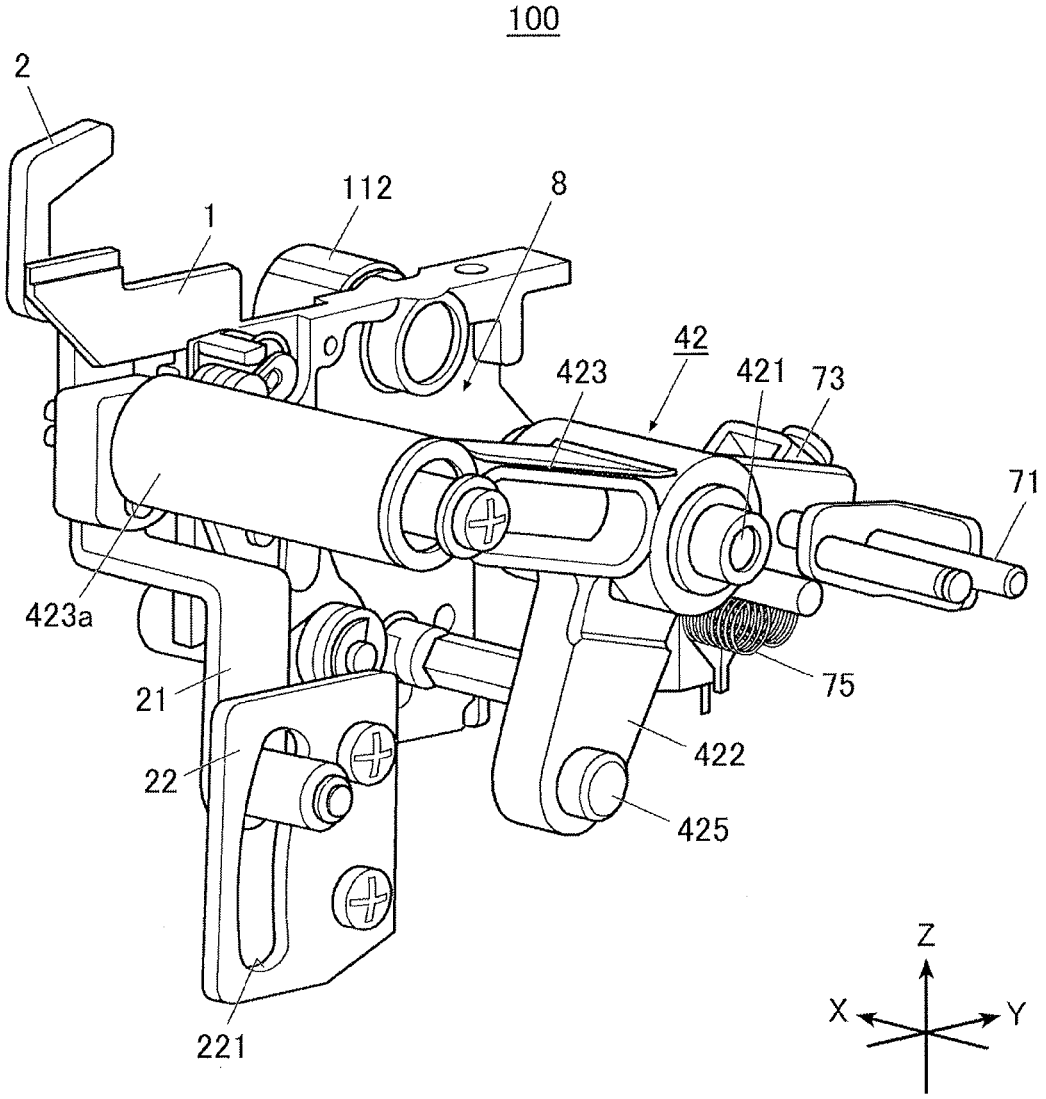
FIG. 3 is a perspective view showing the main portion structure of the embodiment.
Figure 4:
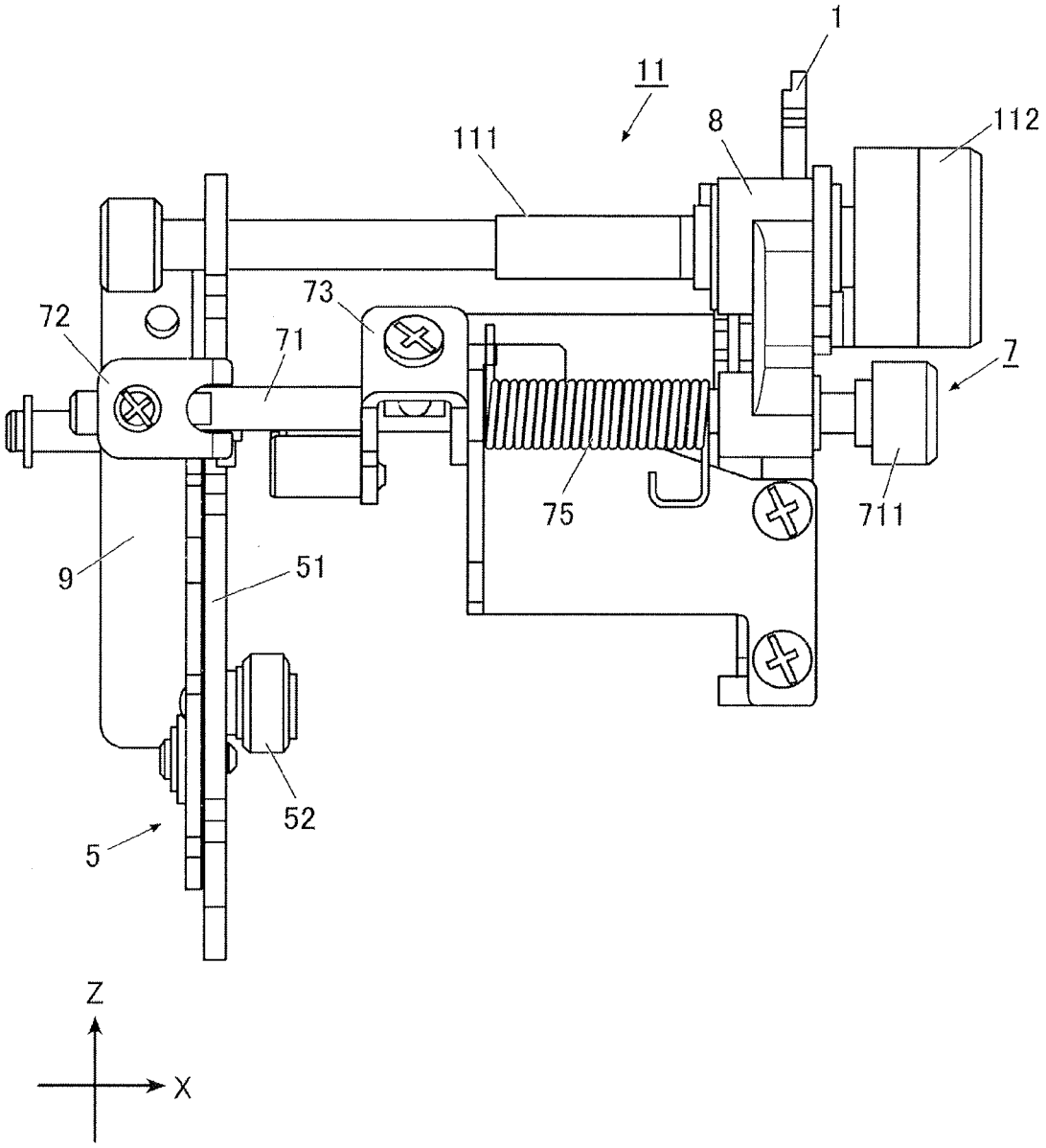
FIG. 4 is a front view showing the main portion structure of the embodiment.
Figure 5:
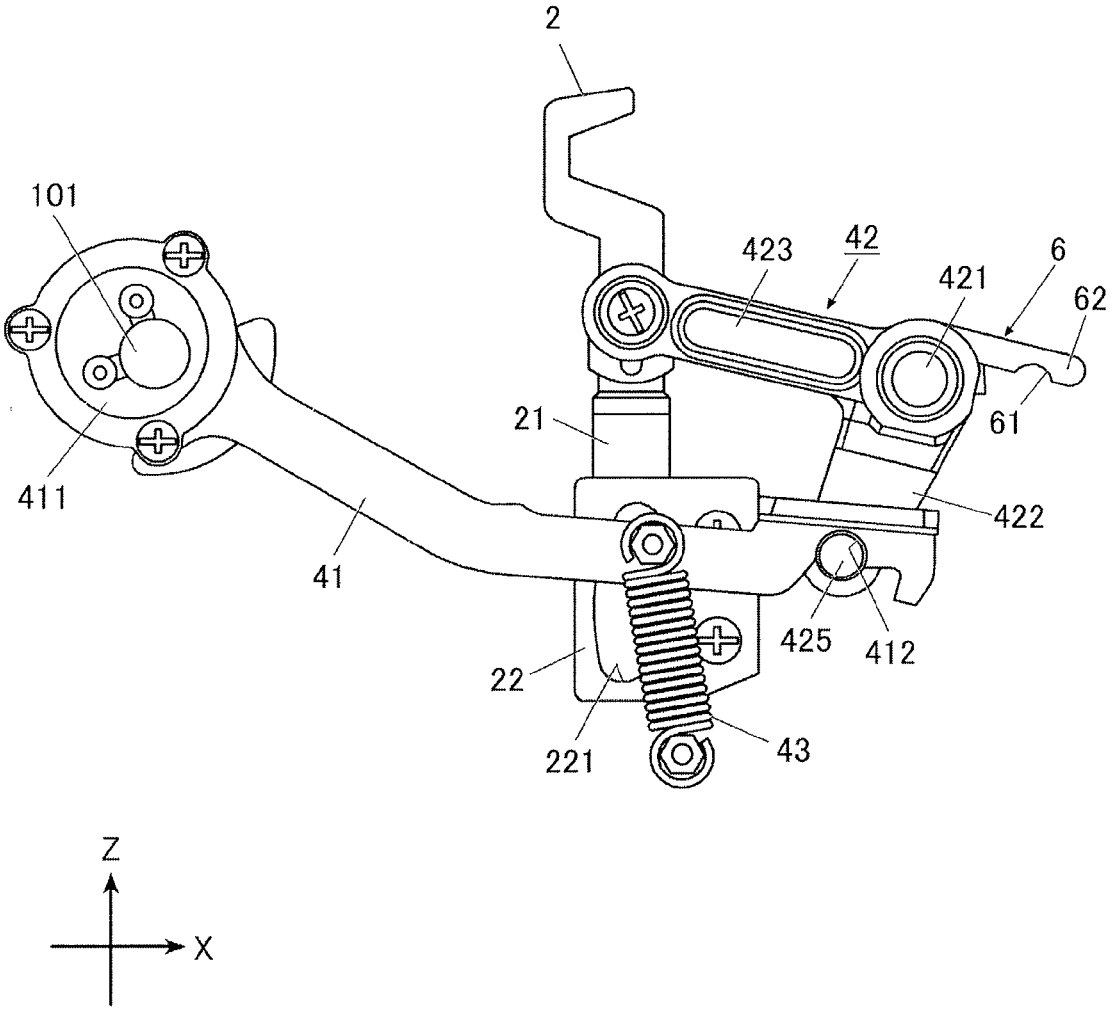
FIG. 5 is one-side view showing the main portion structure of the embodiment.
Figure 6:
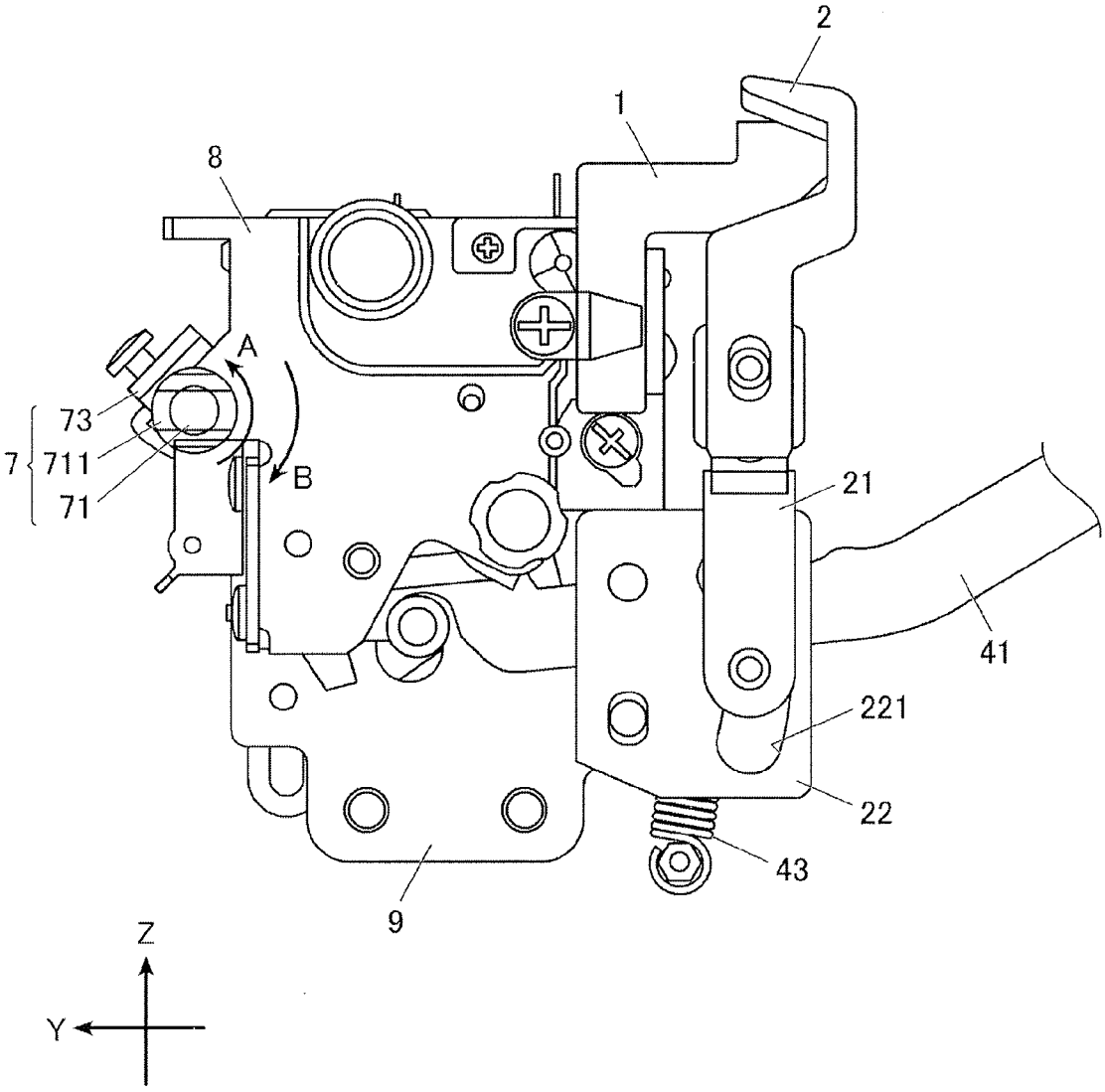
FIG. 6 is the-other-side view showing the main portion structure of the embodiment.
Figure 7:
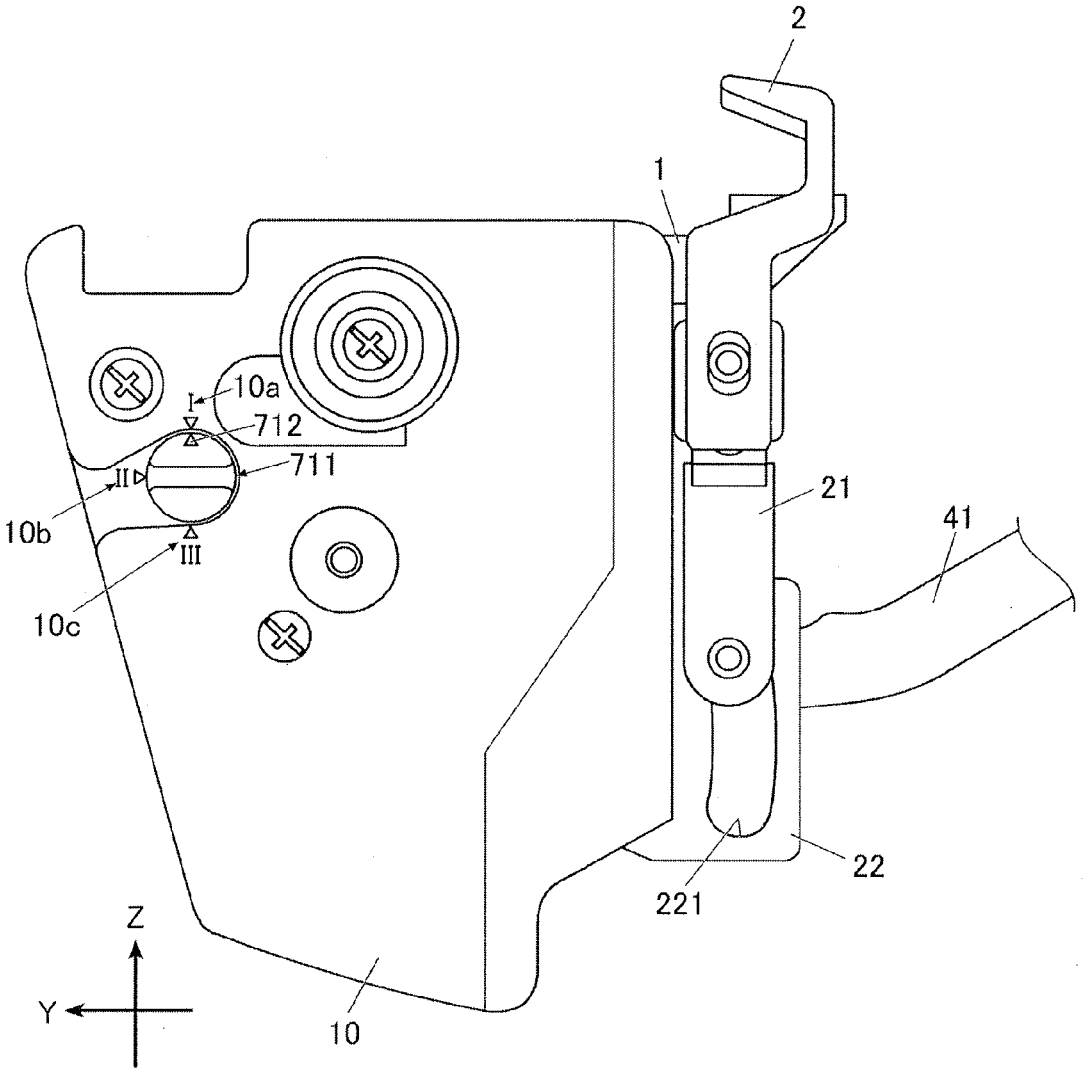
FIG. 7 is the-other-side view with a cover added to the structure of FIG. 6.

FIGS. 1 to 3 are perspective views of the main portion structure of an overlock sewing machine (which is hereinafter called a sewing machine) according to the embodiment, respectively seen from different directions. FIG. 4 is a front view of the main portion structure of the sewing machine, FIG. 5 is one-side view, FIG. 6 is the-other-side view and FIG. 7 is a view with a cover added to the structure of FIG. 6.

Here, a direction parallel to a sewing machine main shaft 101 is defined as an X direction, a direction orthogonal to X direction on a horizontal plane is defined as a Y direction, and a direction orthogonal to the X direction on a vertical plane is defined as a Z direction.

As shown in FIGS. 1 to 7, a sewing machine 100 includes a lower knife 1, an upper knife 2 movable between a retreat position lower than a needle plate 3 (see FIG. 3) and a projection position higher than the retreat position and, at the projection position, when moved vertically from above a sewing object on the needle plate 3, capable of cutting the sewing object, an upper knife drive part 4 for moving the upper knife 2 vertically, an interlock switching part 5 for switching an interlocked state where the upper drive part 4 and upper knife 2 are interlocked with each other and a released state where the upper knife drive part 4 and the upper knife 2 are not interlocked, an upper knife position switching part 6 for switching the arrangement position of the upper knife 2 between the projection position and retreat position, an operation part 7 for switching the mode of the upper knife position switching part 6, and a pair of a lower knife base 8 and a frame 9 spaced a specific clearance from each other for supporting the above parts.

The lower knife 1 is disposed adjacent to the needle plate 3 and is fixed to the lower knife base 8 so as not to project from the upper surface of the needle plate 3.

The upper knife 2 is fixed by an upper knife holder 21. The upper knife holder 21 is liftably held by an upper knife guide 22 supported on the lower knife base 8. In the upper knife guide 22, for guidance of the upper knife holder 21 in the vertical direction (Z direction), there is foamed a long hole 221 which curved-extends in the vertical direction. The long hole 221 has a length enabling the upper knife 2 to move from the projection position to the retreat position.

The operation part 7 is used to drive the interlock switching part 5 and upper knife position switching part 6 simultaneously to thereby switch the mode of the upper knife position switching part 6. The mode of the upper knife position switching part 6 includes first, second and third modes. In the first mode, when the interlock switching part 5 is in an interlocked state, the upper knife position switching part 6 sets the upper knife 2 into the projection position. In the second mode, when the interlock switching part 5 is in a released state, the upper knife position switching part 6 sets the upper knife 2 into the projection position. In the third mode, when the interlock switching part 5 is in a released state, the upper knife position switching part 6 sets the upper knife 2 into the retreat position.

The operation part 7 includes a shaft body 71 disposed to extend parallel to the X direction and supported rotatably on the lower knife base 8/frame 7, a cam portion 73 mounted on the shaft body 71, and a first interlock portion 72 mounted on the shaft body 71 with a specific clearance from the cam portion 73.

On one end of the shaft body 71, there is mounted a handle portion 711 for rotating the shaft body 71. The handle portion 711 is exposed from a cover 10 and can be operated manually. Here, the handle portion 711 may also be operated mechanically. The handle portion 711 includes a position matching mark 712. Meanwhile, the cover 10 also includes three position matching marks 10*a*, 10*b* and 10*c*. The mark 10*a* serves as reference for the first mode. The mark 10*b* serves as reference for the second mode. The mark 10*c* serves as reference for the third mode. By matching the mark 712 of the handle portion 711 to the mark 10*a*, 10*b* and 10*c* of the cover 10, the first to third modes can be switched smoothly.

The cam portion 73 can be rotated together with the shaft body 71 and can be engaged with the upper knife position switching part 6 to operate it. The cam portion 73 includes a pin section 74 projecting parallel to the shaft body 71 and a coil spring 75 for applying a specific-direction energizing force to the cam portion 73.

The first interlock portion 72, in engagement with the interlock switching part 5, can be rotated together with the shaft body 71 to operate the interlock switching part 5.

The upper knife drive part 4 includes a rod 41 oscillatable in interlocking with the sewing machine main shaft 101 and a second interlock portion 42 for driving the upper knife 2.

The rod 41 includes in its one end an eccentric cam 411 rotatable together with the sewing machine main shaft 101. Thus, when the eccentric cam 411 rotates with rotation of the sewing machine main shaft 101, the whole rod 41 can be oscillated.

The rod 41 also includes, in the lower portion of its other end, a notch 412 recessed upwardly.

The rod 41 further includes a spring 43 interposed between the rod 41 and a sewing machine frame (not shown) and serving as an energizing member for applying an energizing force to the rod 41 in a direction where the notch 412 and engaging portion 425 (to be discussed later) are closely contacted with each other.

The second interlock portion 42 includes a rotation shaft 421 parallel to the X direction, a base section 422 extending downward from the rotation shaft 421 and an arm section 423 extending from the rotation shaft 421 to the upper knife holder 21 and connected to such holder 21.

On the base section 422, there is mounted the engaging portion 425 engageable with the notch 412 of the rod 41. The engaging portion 425 has a cylindrical shape extending parallel to the X direction. While the engaging portion 425 is engaged with the notch 412, their engagement is made firm by the spring 43. When the rod 41 oscillates in this state, the second interlock portion 42 oscillates about the rotation shaft 421 following the oscillation of the rod 41. In oscillation, the upper knife holder 21 connected to the arm section 423 moves up and down while being guided by the upper knife guide 22, whereby the upper knife 2 slides up and down relative to the lower knife 1. Cooperation of the upper and lower knives 2 and 1 allowed by this slide can cut the edge of a cloth.

An compression spring is inserted into the cylindrical section 423*a* of the arm section 423 connected to the upper knife holder 21, whereby the upper knife holder 21 is energized to move in the horizontal direction following the movement of the lower knife base 8 in the X direction. Thus, even when the lower knife holder 21 is moved by a knife position adjusting mechanism 11, the blades of the lower and upper knives 1 and 2 are always allowed to coincide.

The upper knife position switching part 6 is formed integrally with the second interlock portion 42 in such a manner that it extends from the rotation shaft 421 oppositely to the arm section 423. In the lower edge of substantially the center of the upper knife position switching part 6, there is formed a notch 61 with which, when the cam portion 73 of the operation part 7 rotates up to a specific position, the pin section 74 of the cam portion 73 can be engaged.

Figure 8:
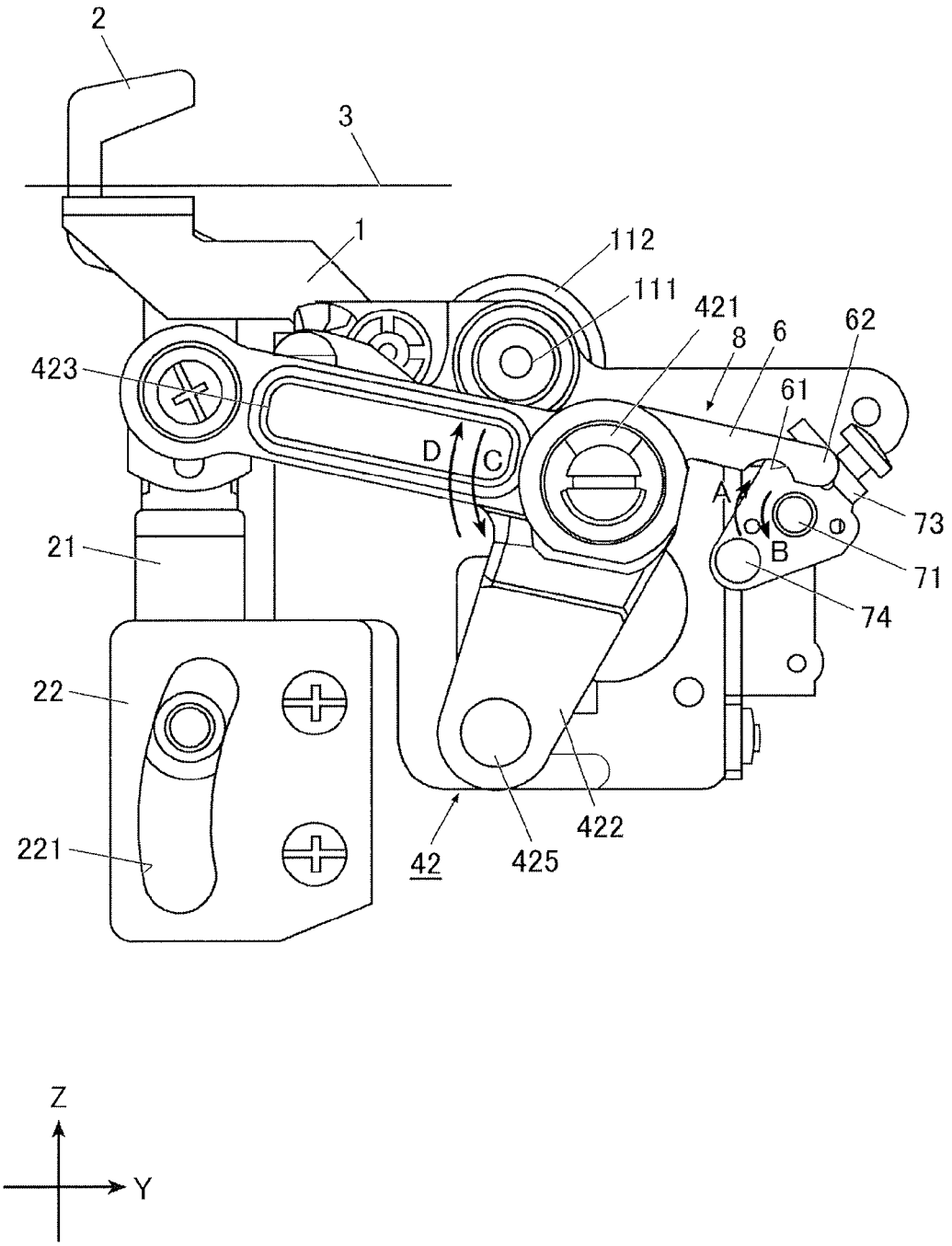
FIG. 8 is a side view showing a first mode.
Figure 9:
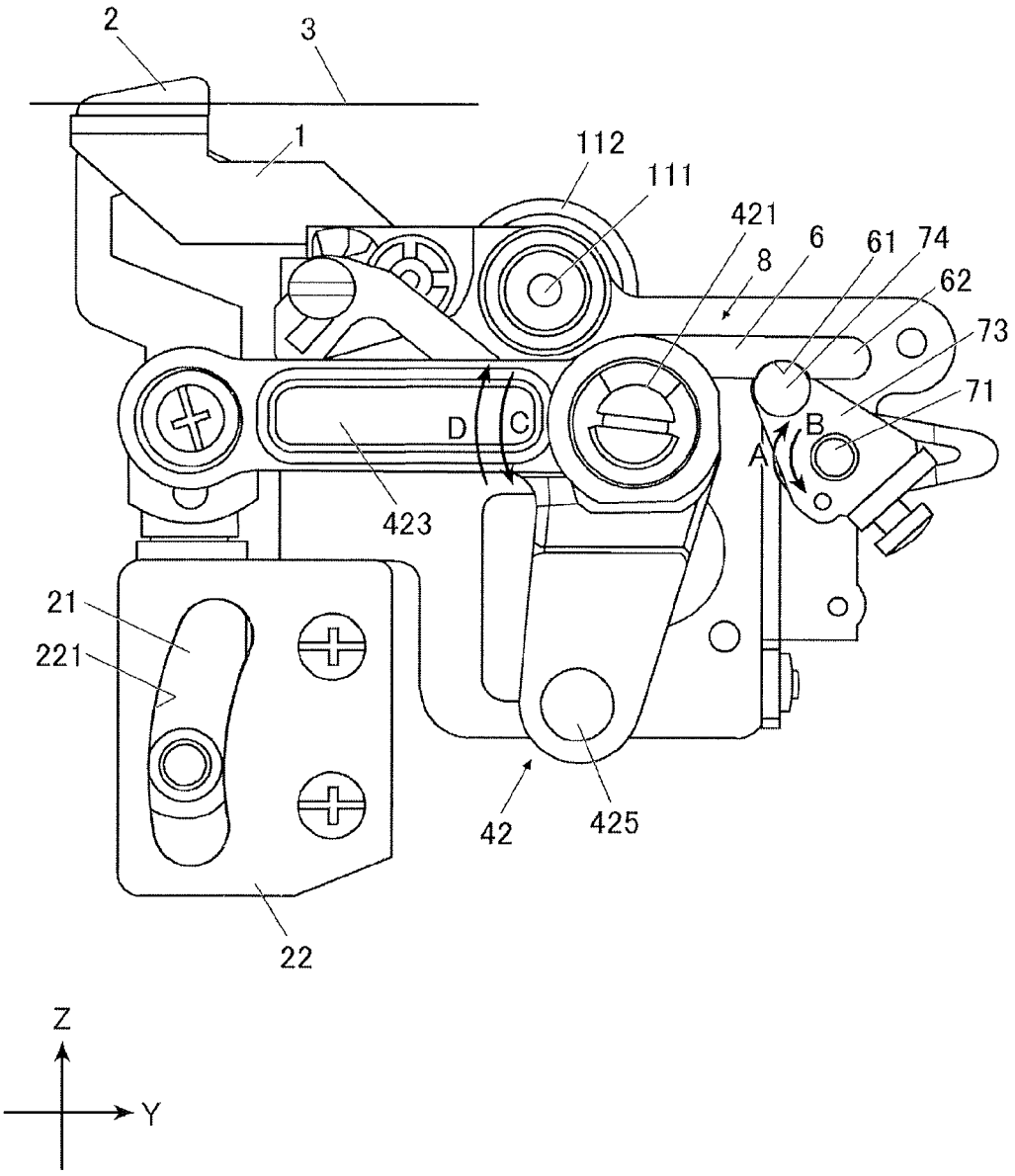
FIG. 9 is a side view showing a second mode.

FIG. 8 shows the state of the first mode where the position matching mark 712 of the handle portion 711 coincides with the mark 10*a* of the cover 10 but the pin portion 74 of the operation part 7 is not contacted with the upper knife position switching part 6. In this state, the upper knife 2 is set at the projection position above the needle plate 3. When the handle portion 711 of the handle part 7 is operated such that the shaft body 71 and cam portion 73 are rotated in the arrow A direction, with this rotation, the pin portion 74 is engaged with the upper knife position switching part 6. After this engagement, when the shaft body 71 and cam portion 73 are further rotated in the arrow A direction and the position matching mark 712 coincides with the mark 10*b*, as shown in FIG. 9, the pin portion 74 is engaged with the notch 61 of the upper knife position switching part 6. Thus, when the upper knife position switching part 6 is pushed up, the second interlock portion 42 rotates in the arrow C direction about the rotation shaft 421. With this rotation, the arm section 423 of the second interlock portion 42 moves the upper knife 2 to a guide position. Here, the guide position is a position capable of guiding a sewing object and, specifically, it exists in the projection position and is lower than the upper dead center of the upper knife 2. The cam portion 73 is engaged with the notch 61 of the upper knife position switching part 6, whereby the arrangement position of the upper knife 2 in the second mode is restricted to the guide position. That is, the notch 61 provides a first restriction part according to the invention.

Figure 10:
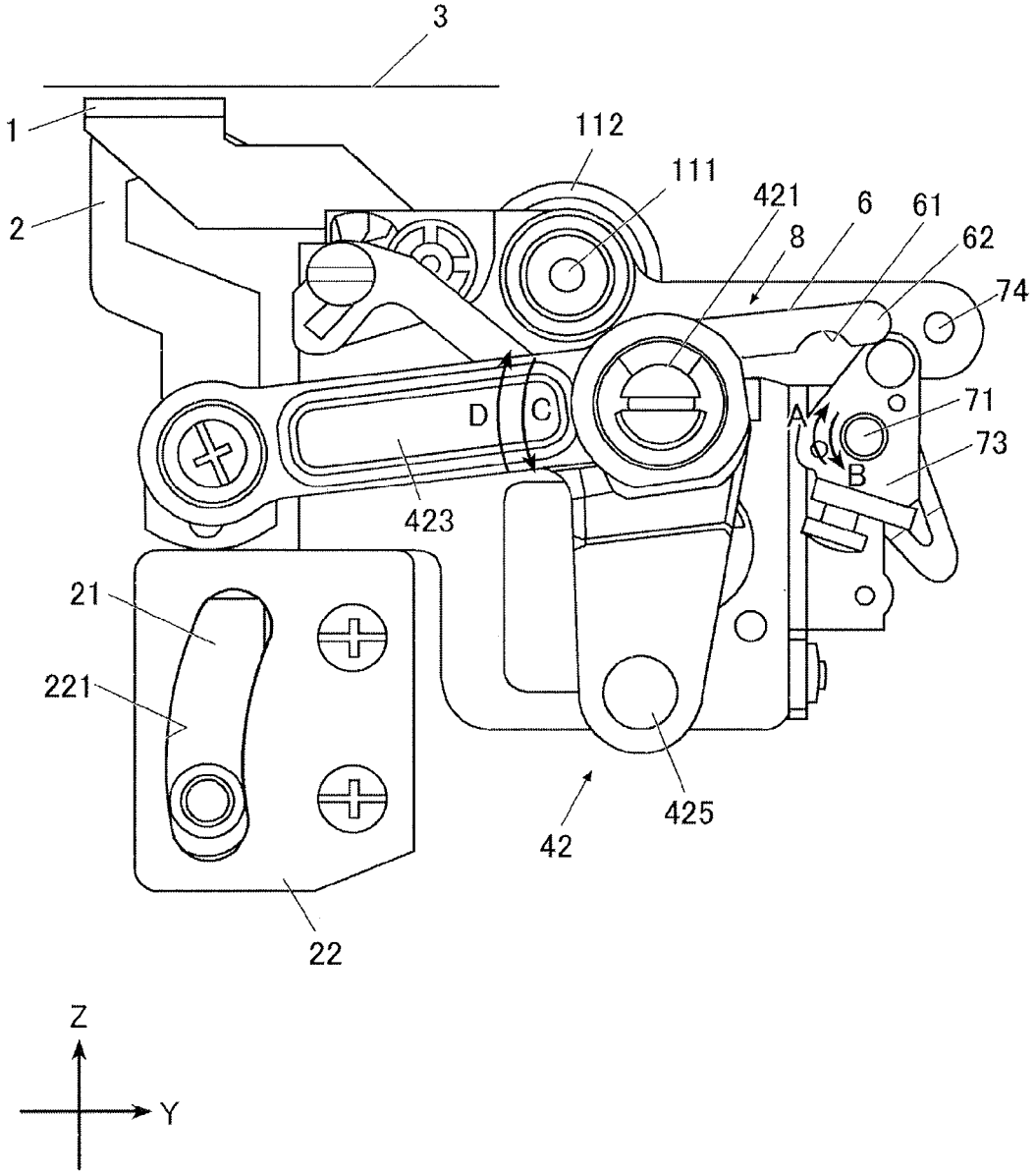
FIG. 10 is a side view showing a third mode.

When the shaft body 71 and cam portion 73 rotate further in the arrow A direction and the position matching mark 712 coincides with the mark 10*c*, as shown in FIG. 10, the pin portion 74 is engaged with the tip end 62 of the upper knife position switching part 6 to push it up. When the upper knife position switching part 6 is pushed up, the second interlock portion 42 rotates in the arrow C direction about the rotation shaft 421. With this rotation, the arm section 423 of the second interlock portion 42 moves the upper knife 2 from the guide position to the retreat position. In this case, since the coil spring 75 applies an energizing force to the cam portion 73, the upper knife position switching part 6 is restricted from moving downward. That is, the engagement of the cam portion 73 with the tip end 62 of the upper knife position switching part 6 restricts the upper knife in the third mode to the retreat position. Thus, the tip end 62 provides a second restriction part of the invention.

And, when the handle portion 711 is operated such that the position matching mark 712 coincides with the mark 10*a* from the mark 10*c*, the shaft body 71 and cam portion 73 rotate in the arrow B direction and, with this rotation, the pin portion 74 is disengaged from the upper knife position switching part 6. In this case, the energizing force by the coil spring 75 in the arrow A direction is removed. This lowers the upper knife position switching part 6, thereby rotating the second interlock portion 42 in the arrow D direction about the rotation shaft 421. This rotation allows the arm section 423 of the second arm portion 42 to move the upper knife 2 from the retreat position to the projection position. That is, in the state of the cam portion 73 not engaged with the upper knife position switching part 6, the upper knife 2 in the first mode is set to the projection position.

Figure 11:
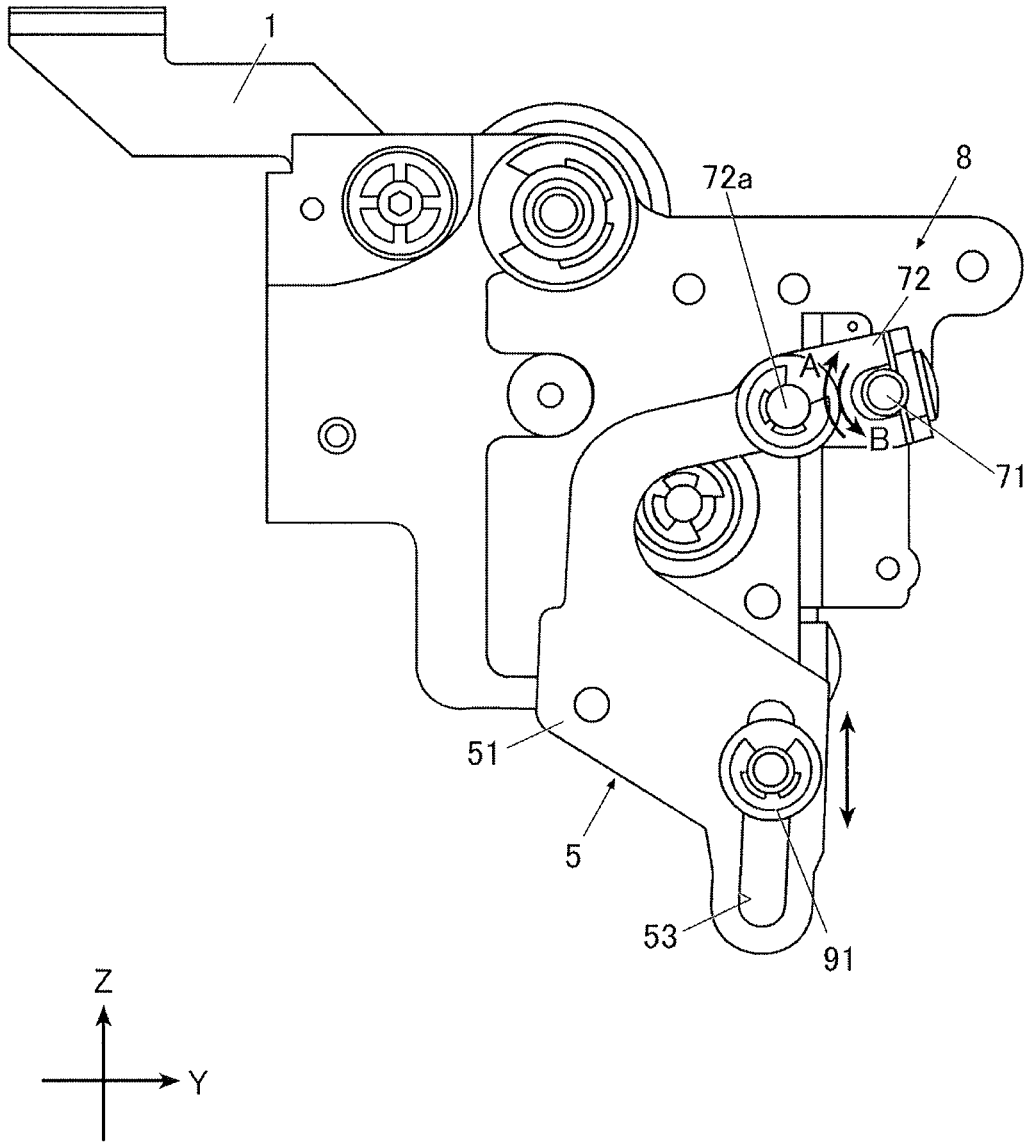
FIG. 11 is a side view showing the schematic structure of an interlock switching part according to the embodiment.

FIG. 11 is a side view of the schematic structure of the interlock switching part 5. As shown in FIG. 11, the interlock switching part 5 includes a plate-shaped member 51 slidable vertically relative to the frame 9, and a roller 52 (to be discussed later) mounted integrally on the plate-shaped member 51 and, according to the sliding operation of the plate-shaped member 51, engageable with the rod 41.

The first interlock portion 72 is connected to the shaft body 71 and, when the handle portion 711 of the operation part 7 is operated, the first interlock portion 72 rotates together with the shaft body 71.

In the hole (not shown) of the upper portion of the plate-shaped member 51, there is inserted the shaft section 72*a* of the first portion 72 and, with rotation of the first interlock portion 72, the plate-shaped member 51 rotates. The plate-shaped member 51 includes in its lower portion a long hole 53 for restricting the movement of the plate-shaped member 51 to the vertical direction and, into this long hole 53, there is engaged a pin portion 91 formed in the frame 9. Also, the plate-shaped member 51 is energized in the X direction toward the handle portion 711 by a spring 76 provided on the shaft section 72*a*.

Figure 12:
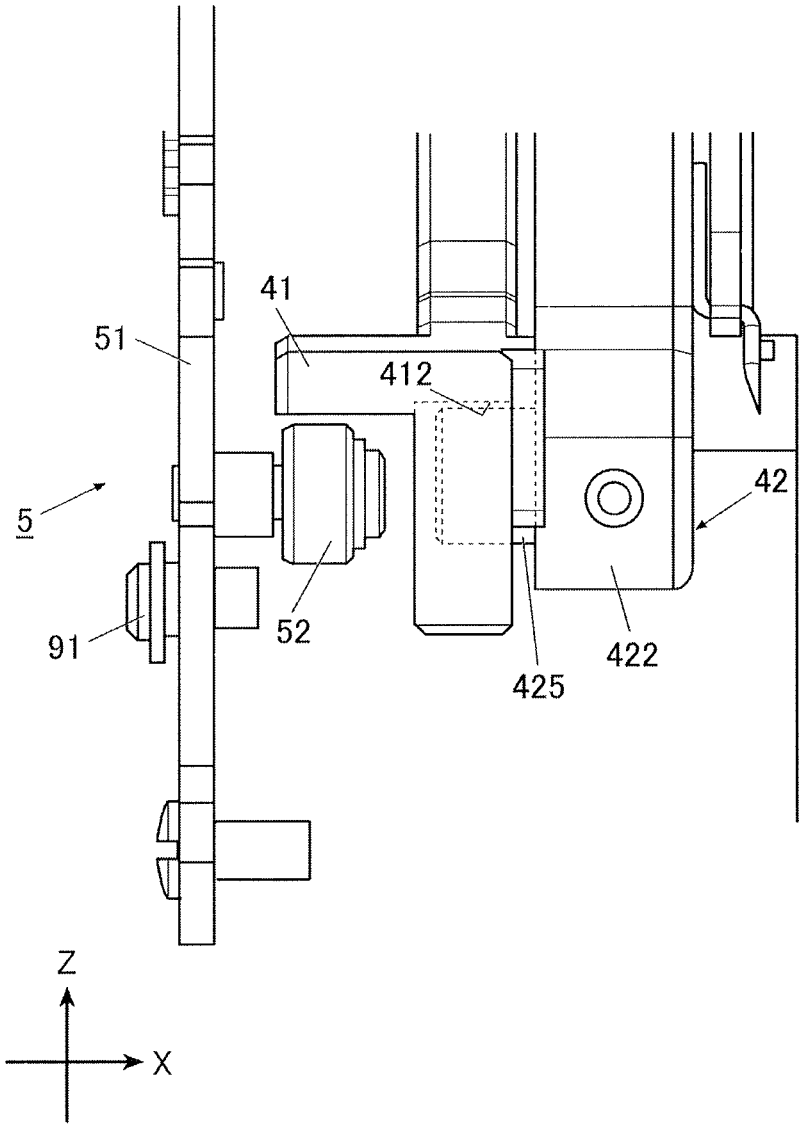
FIG. 12 is an enlarged front view showing an interlocked state according to the embodiment where the notch of a rod and the engaging portion of a second interlock part are engaged.

FIG. 12 is an enlarged front view to show a interlocked state where the notch 412 of the rod 41 and the engaging section 425 of the second interlock portion 42 are engaged. As shown in FIG. 12, in the interlocked state, the plate-shaped member 51 is arranged at a position where the roller 52 is separated from the rod 41.

Figure 13:
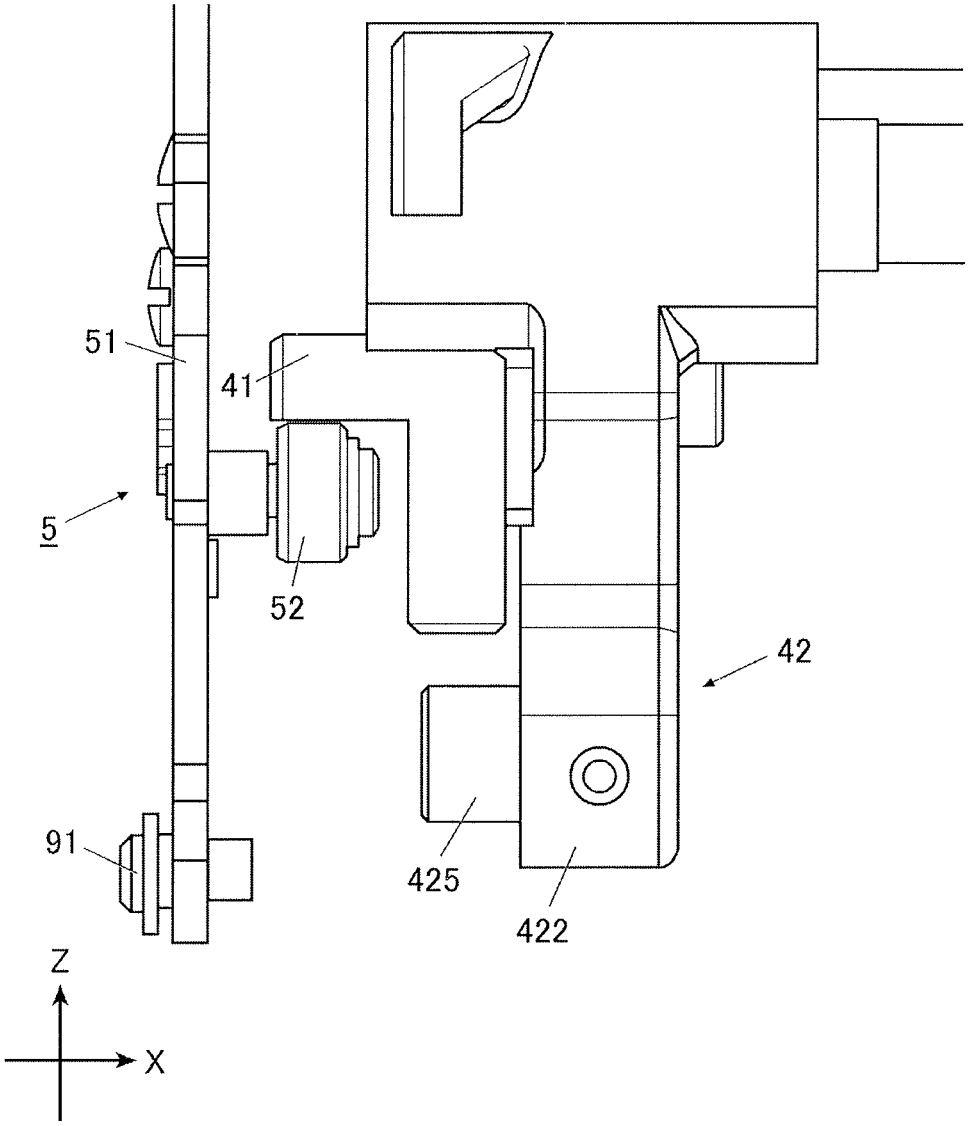
FIG. 13 is an enlarged front view to show a released state according to the embodiment where the rod notch and the second interlock part engaging portion are not engaged.
Figure 14:
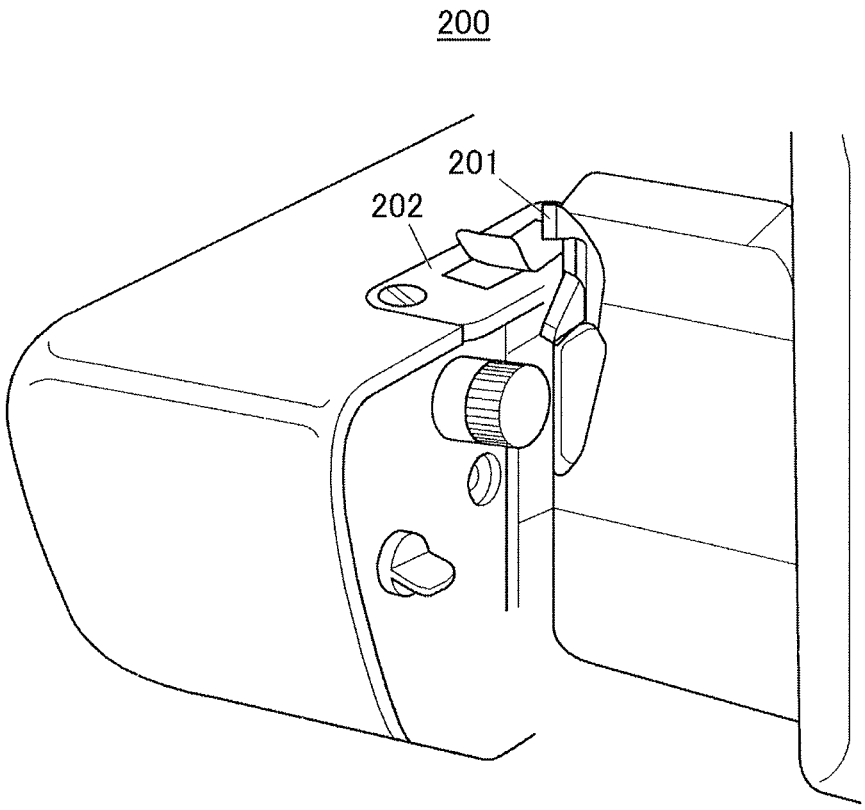
FIG. 14 is a perspective view of the main portion structure of a conventional sewing machine.

And, when the handle portion 711 of the operation part 7 is operated such that the shaft body 71 and first interlock portion 72 rotate in the arrow A direction, with rotation of the first interlock portion 72, the plate-shaped member 51 rises. With this rising, as shown in FIG. 13, the roller 52 rises to move the rod 41, thereby disengaging the notch 412 from the engaging section 425 to provide a released state.

When the handle portion 711 of the operation part 7 is operated such that the shaft body 71 and cam portion 73 rotate in the arrow B direction, with rotation of the first interlock portion 72, the plate-shaped member 51 lowers and, as shown in FIG. 12, the roller 52 also lowers. Since the rod 41 is energized downward by the spring 43, together with lowering of the roller 52, as the roller 52 lowers, the rod 41 lowers, whereby the notch 412 is engaged with the engaging section 425 to provide the interlocked state.

Here, when setting the second and third modes, in order to prevent oscillation of the rod 41 from being transmitted to the upper knife 2, there must be provided the released state which releases the interlock between the upper knife drive part 4 and upper knife 2. Meanwhile, when setting the first mode, in order to enable transmission of the rod 41 oscillation to the upper knife 2, there must be provided the interlocked state enabling interlock between the upper knife drive part 4 and upper knife 2. The position relationship of the first interlock portion 72 for operating the interlock switching part 5 and the cam portion 73 for operating the upper knife position switching part 6 to the shaft body 71 is set such that the above-mentioned relationship can be satisfied.

The sewing machine 100 also includes a knife position adjusting mechanism 11 for adjusting the horizontal-direction positions of the lower and upper knives 1 and 2. As shown in FIG. 4, the knife position adjusting mechanism 11 includes an adjusting shaft portion 111 extended between the lower knife base 8 and frame 9 parallel to the shaft body 71. On the lower knife base 8 side end of the adjusting shaft portion 111, a handle 112 is provided to be exposed from the cover 10. The adjusting shaft portion 111 includes, for example, a screw mechanism, whereby, when the handle 112 is rotated, the portion 111 can be extended and contracted in the axial direction. With extension and contraction of the adjusting shaft portion 111, the lower knife base 8 moves in the X direction and the upper knife holder 21 also moves in the X direction following the lower knife base 8. That is, by operating the handle 112, the horizontal-direction positions of the lower and upper knives 1 and 2 can be adjusted.

Next, description is given of the operation of the sewing machine 100 of the embodiment.

Firstly, when cutting a cloth edge by the upper knife 2 for sewing, the handle portion 711 of the operation part 7 is operated and rotated up to a position where the position matching mark 712 and mark 10*a* coincide, whereby the upper knife 2 is set at the projection position and the upper knife drive part 4 and upper knife 2 are interlocked with each other, thereby setting the first mode. In the first mode, the upper knife 2 vertically moves from above a sewing object on the needle plate 3 and cooperates with the lower knife 1 to cut the sewing object.

When cutting of the cloth edge using the upper knife 2 is unnecessary and the sewing object is sewn using the upper knife 2 as a guide for the sewing object, an operator operates the handle portion 711 of the operation part 7 such that the shaft body 71, first interlock portion 72 and cam portion 73 are rotated in the arrow A direction up to a position where the position matching mark 712 and mark 10*b* coincide, whereby the upper knife 2 is moved to the guide position and is also removed from the upper knife drive part 4, thereby setting the second mode.

Also, when cutting of the cloth edge using the upper knife 2 is unnecessary and sewing is performed without using a guide for the sewing object, the operator operates the handle portion 711 of the operation part 7 such that the shaft body 71, first interlock portion 72 and cam portion 73 are rotated further in the arrow A direction up to a position where the position matching mark 712 and mark 10*c* coincide, whereby, while the upper knife drive part 4 and upper knife 2 remain removed from each other, the upper knife 2 is moved to the retreat position, thereby setting the third mode.

When use of the upper knife 2 is necessary again, the operator operates the handle portion 711 of the operation part 7 such that the shaft body 71, first interlock portion 72 and cam portion 73 are rotated in the arrow B direction up to a position where the position matching mark 712 and mark 10*a* coincide, whereby the upper knife 2 is moved to the projection position and is also interlocked with the upper knife drive part 4, thereby setting the first mode.

As described above, according to the embodiment, by operating the operation part 7, the first mode (interlocked state), second mode (guide state) and third mode (retreat state) are switched over to each other, thereby enabling switching between the interlocked state, guide state and retreat state, and thus enabling enhancement in use of the sewing machine 1.

Also, since the upper knife position switching part 6 includes the first restriction part (notch 61) and second restriction part (tip end 62), simply by changing the contact position of the cam portion 73 with the upper knife position switching part 6, the upper knife 2 can be set at positions proper for the second and third modes. Further, in the state of the cam portion 73 not engaged with the upper knife position switching part 6, the upper knife 2 can be set at a position proper for the first mode.

Also, in the second mode, since the upper knife 2 is set at the position existing in the projection position and lower than the upper dead center of the upper knife 2, its use as a guide can be facilitated.

And, since the knife position adjusting mechanism 11 adjusts the horizontal-direction position of the upper knife 2, when the upper knife 2 is used as a guide, it can be set at the optimum position, thereby enabling further enhancement in use.

Here, the invention is not limited to the above embodiment but can be changed properly. For example, the structure of the invention can also be applied to a sewing machine including a mechanism capable of moving the upper and lower knives 2 and 1 in the X direction for adjusting the sewing width.

The invention claimed is:

1. An overlook sewing machine, comprising:

an upper knife movable to a retreat position below a needle plate or a projection position above the needle plate, and, when moving vertically from above the needle plate, capable of cutting a sewing object in cooperation with a lower knife;

an upper knife drive part for vertically moving the upper knife;

an interlock switching part configured to switch an interlocked state where the upper knife drive part and the upper knife are interlocked and a released state where the upper knife drive part and the upper knife are not interlocked;

an upper knife position switching part configured to switch the upper knife between the projection position and the retreat position; and an operation part configured to drive the interlock switching part and the upper knife position switching part to switch the upper knife position switching part between the following three modes, that is, a first mode where the interlock switching part provides the interlocked state and the upper knife position switching part sets the upper knife at the projection position, a second mode where the interlock switching part provides the released state and the upper knife position switching part sets the upper knife at the projection position, and a third mode where the interlock switching part provides the released state and the upper knife position switching part sets the upper knife at the retreat position.

2. The overlock sewing machine according to claim 1, wherein the upper knife in the second mode is set at a guide position which exists within the projection position and is lower than a top dead center of the upper knife.

3. The overlock sewing machine according to claim 2, wherein the operation part includes a rotatable shaft body and a earn portion rotatable with the shaft body and engageable with the upper knife position switching part to operate such part, and the upper knife position switching part includes a first restriction portion, due to the engagement of the cam portion, for restricting the upper knife in the second mode to the guide position, and a second restriction portion, due to engagement of the cam portion with a position different from the first restriction portion, for restricting the upper knife in the third mode to the retreat position.

4. The overlock sewing machine according to claim 3, wherein the upper knife position switching part, when the cam portion is not engaged with the upper knife position switching part, switches the upper knife to the projection position in the first mode.

5. The overlock sewing machine according to claim 1, further including a knife position adjusting mechanism for adjusting horizontal-direction positions of the lower knife and the upper knife.

* * * * *